United States Patent [19]

Rede et al.

[11] Patent Number: 4,565,287

[45] Date of Patent: Jan. 21, 1986

[54] APPARATUS FOR PRESERVATION OF A LEATHER GLOVE

[75] Inventors: Hector Rede, 634 Cougar Loop NE., Albuquerque, N. Mex. 87122; Armand G. Winfield; Barbara L. Winfield, both of Santa Fe, N. Mex.

[73] Assignee: Hector Rede, Albuquerque, N. Mex.

[21] Appl. No.: 619,615

[22] Filed: Jun. 11, 1984

[51] Int. Cl.[4] ..... B65D 81/26

[52] U.S. Cl. ..... 206/213; 8/94.23; 150/52 R; 206/204; 206/278; 223/78

[58] Field of Search ..... 2/16, 159, 167; 8/94.22, 94.23, 150.5; 69/19, 20, 33; 118/201, 206, 504; 150/52 R; 206/0.5, 204, 205, 207, 213, 213.1, 216, 278, 296; 223/78–80

[56] References Cited

U.S. PATENT DOCUMENTS

| | | | |
|---|---|---|---|
| 2,469,763 | 5/1949 | Conwell | 206/207 |
| 2,908,308 | 10/1959 | Dearholt | 150/52 R |
| 2,994,404 | 8/1961 | Schifferly | 206/0.5 |
| 3,159,504 | 12/1964 | Sarjanian et al. | 223/80 |
| 3,494,726 | 2/1970 | Barasch | 206/213 |
| 4,061,170 | 12/1977 | Marks | 150/52 R |
| 4,382,508 | 5/1983 | Robbins et al. | 206/216 |
| 4,418,849 | 12/1983 | Santa | 223/78 |

*Primary Examiner*—William T. Dixson, Jr.
*Assistant Examiner*—Jimmy G. Foster
*Attorney, Agent, or Firm*—William A. Eklund

[57] ABSTRACT

An apparatus for preservation of a leather glove. A hollow perforated hand-shaped form, sized to fit snugly within a glove, contains a dehydrating agent which draws moisture out of the glove. The form and glove are insertable in a protective case. The case includes a porous inner lining which is impregnated with a leather emollient. The combined action of the dehydrating agent and the emollient-impregnated lining is to remove moisture, thereby preventing the formation of mold or mildew, and at the same time infuse the emollient into the glove to maintain its suppleness and flexibility.

8 Claims, 3 Drawing Figures

APPARATUS FOR PRESERVATION OF A LEATHER GLOVE

BACKGROUND OF THE INVENTION

The invention described and claimed herein is generally related to apparatus for preservation of leather articles such as gloves.

Leather gloves, particularly those used in athletics such as golf, baseball, handball and racquetball, are commonly short-lived due to the combined effects of desiccation and moisture, in addition to ordinary wear and tear. By desiccation is meant here the loss from the leather of essential oils and fats which normally operate to keep the leather flexible, soft and supple. In this regard, the frequency use of the gloves in their ordinary application results in desiccation through the effects of sunlight, perspiration and abrasion. If allowed to persist, such desiccation usually leads to the drying and cracking of the leather.

Leather gloves also undergo deterioration by the effects of mold or mildew, which thrive particularly well in leather moistened with perspiration. This problem is particularly acute when the glove is used daily and stored in a damp enclosed space, such as in a locker or in a golf bag or other athletic bag. When so stored there is often insufficient time for the gloove to be thoroughly dried between uses. This problem is even more acute in humid climates, where even thorough airing may not dry the glove sufficiently to prevent the growth of mold or mildew.

Simply drying the glove by artificial means between uses is not satisfactory. This approach may prevent deterioration by mold or mildew, but aggravates deterioration by desiccation. Gloves which are repeatedly moistened by perspiration and artificially dried between uses typically undergo drying and cracking in a short time. Similarly, treatment of the glove with emollients, and nothing more, may prevent damage due to dessication, but does nothing to prevent the development of mold or mildew in damp gloves. There has not been previously available a simple method or apparatus for treating a glove to both remove moisture and add essential emollients at the same time.

Accordingly, it the object and purpose of the present invention to provide an apparatus for the preservation of leather gloves.

It is a more specific object of the present invention to provide an apparatus which operates to prevent deterioration of a leather glove by the effects moisture of, yet which also replenishes essential oils necessary to maintain the resiliency and suppleness of the glove.

SUMMARY OF THE INVENTION

In accordance with the objects and purposes of the present invention, there is provided an apparatus for the preservation of a leather glove, comprising a protective closable case having a porous inner lining suitable for impregnation with a leather emollient. The apparatus further comprises a hollow, vapor-permeable, hand-shaped form which is insertable in a leather glove. The hand-shaped form is hollow and is adapted to contain a suitable dehydrating agent. The apparatus, when provided with a suitable dehydrating agent and a suitable leather emollient, operates effectively to dry a moist glove and at the same time infuse the glove with an emollient to maintain its flexibility and suppleness.

In accordance with another aspect of the invention, the hand-shaped form consists of two parts, a thumb part and a hand part. Such an arrangement results in two advantages. First, it facilitates insertion of the form into a glove, by allowing the insertion first of the thumb part followed by insertion of the hand part. Secondly, this arrangement allows the two-part form to be used with either a left-handed or right-handed glove. In the preferred embodiment the thumb and hand parts have cooperable concave/convex surfaces which allow the thumb part to be rotated in either direction about the hand part to accomodate either type of glove.

These and other aspects of the present invention will be more apparent upon consideration of the following detailed description and accompanying drawings of the preferred embodiment of the invention.

BRIEF DESCRIPTION OF THE DRAWINGS

The accompanying drawings, which are incorporated in and form a part of the specification, illustrate a preferred embodiment of present invention. In the drawings.

DETAILED DESCRIPTION OF THE PREFERRED EMBODIMENT

Figure 1:
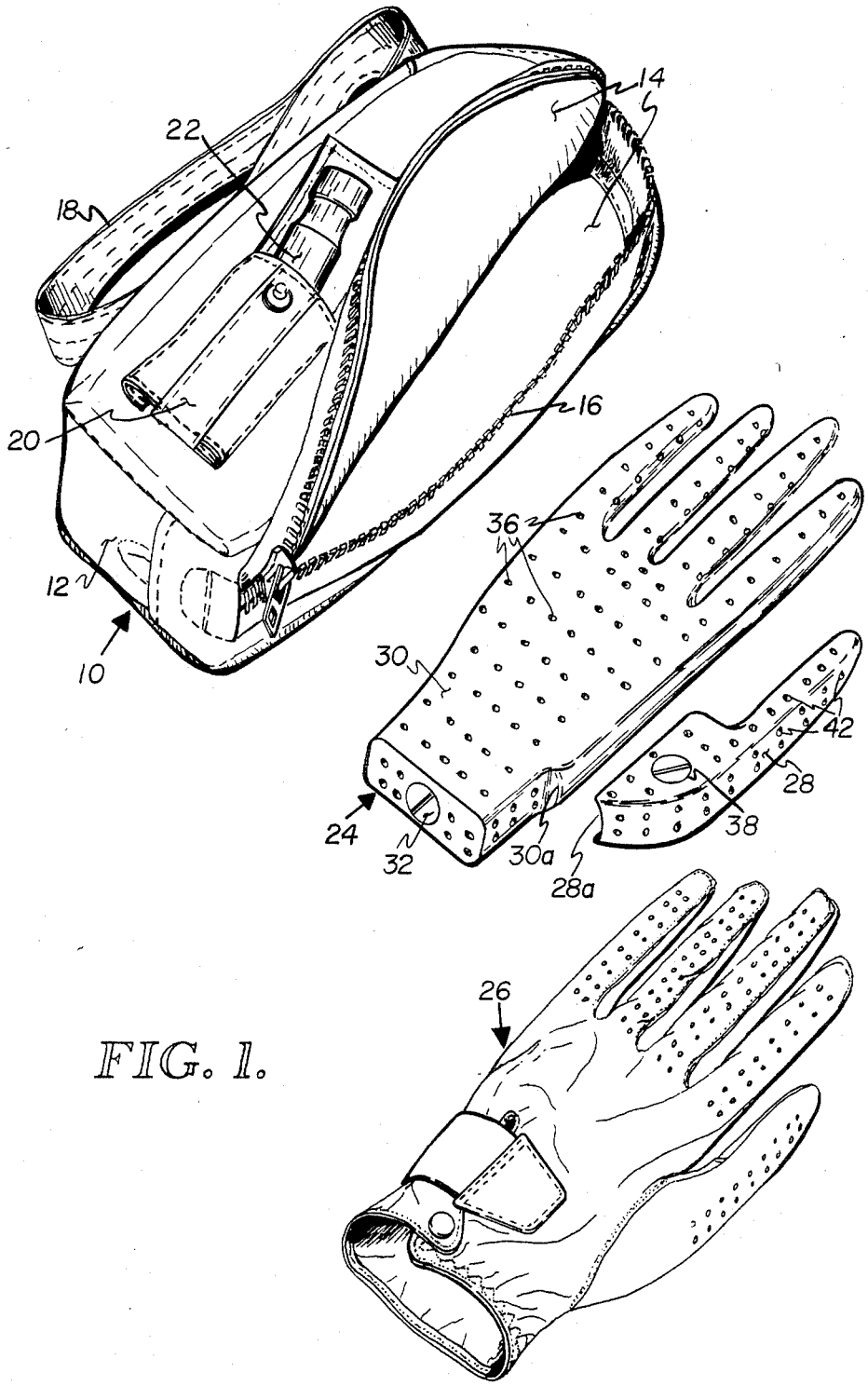
FIG. 1 is an exploded pictorial view of the preferred embodiment of the present invention, together with a leather glove which forms no part of the invention.
Figure 2:
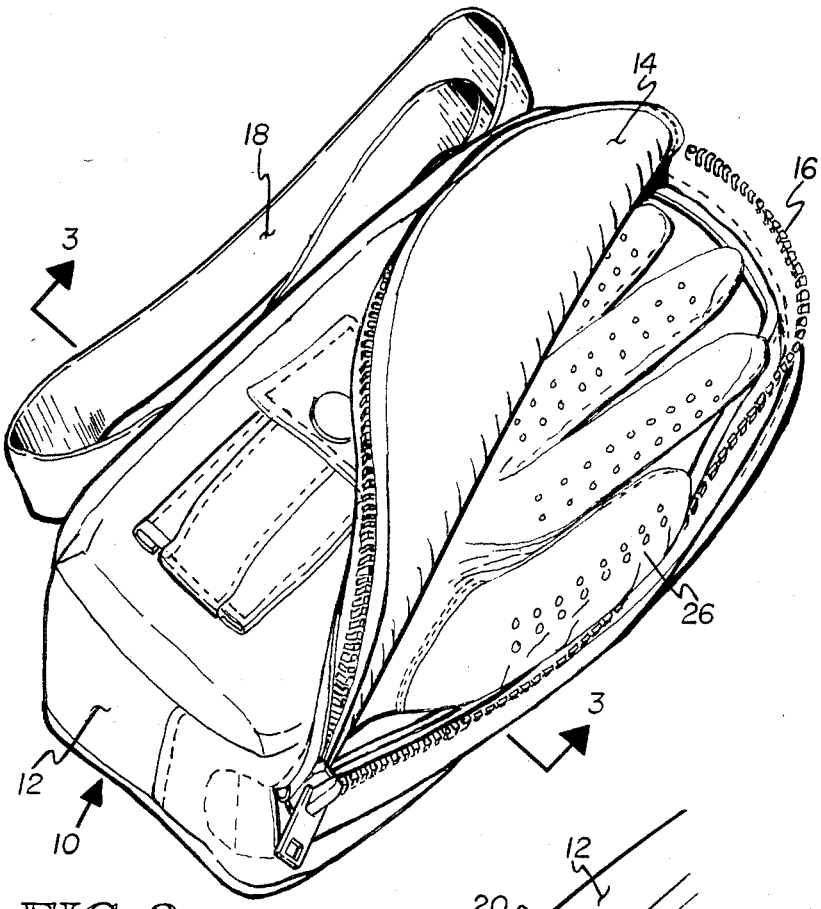
FIG. 2 is a pictorial view of the apparatus of FIG. 1, as assembled.
Figure 3:
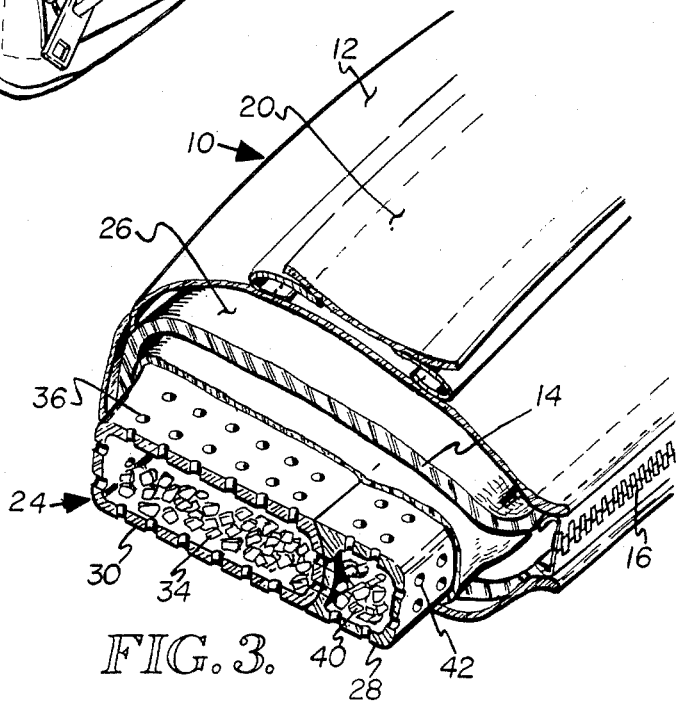
FIG. 3 is an isometric view in cross section of the assembled apparatus of FIG. 1, taken along section line 3—3 of FIG. 2.

Referring to FIGS. 1 through 3, the preferred embodiment of the present invention includes a protective case 10 which includes an outer shell 12 formed of suitable heavy fabric or polymeric material. The case 10 includes an inner lining 14 which is approximately $\frac{1}{8}$ inch thick and which is formed of a porous open cell polyvinyl chloride (PV) polymer having a pore size of not greater than 100 pores per linear inch. Another suitable material for the lining 14 is sintered polyvinyl chloride, in which case the pore size should be at least 100 pores per linear inch. The case 10 is closable by means of plastic zipper 16 which extends around two edges of the generally rectangular case. The case further includes a handle 18, and a closable pocket 20 adapted to hold a vial 22 of leather emollient, discussed further below.

A two-part hand-shaped form 24 is shaped so as to be insertable in a leather glove, such as the glove 26 illustrated in the Figures. The form 24 consists of independent thumb and hand parts, 28 and 30 respectively. The hand part 30 includes a convex edge **30*a*, illustrated best in FIG. 1, which conforms with a cooperable concave inner edge 28*a* of the thumb part 28. This arrangement allows the thumb part 28 to be rotated slightly in either direction about the convex edge 30*a*, thereby enabling the form 24** to be used with either left-handed or right-handed gloves. Additionally, it has been found that the use of separable hand and thumb parts greatly facilitates the insertion of the form into a glove, ordinarily by first inserting the thumb part followed by the hand part.

The hand part 30 is hollow and is provided with a threaded plug 32 which allows the hand part to be filled with a dehydrating agent 34, illustrated in FIG. 3. The hand part 30 is provided with numerous perforations 36, which allow moisture to pass from a glove into the dehydrating agent 34. The thumb part 28 is likewise hollow and provided with a removable plug 38, dehydrating agent 40 and numerous perforations 42.

Any suitable dehydrating agent may be used in the form 24. Preferred compositions are calcium sulfate and silica gel. There is preferably also included in the dehydrating agent a suitable saturation indicator, such as cobalt chloride, which changes color when the dehydrating agent is saturated with moisture and therefore needs to be replaced or regenerated. The thumb and hand parts 28 and 30 may preferably be transparent or translucent so that the color of the indicator is readily apparent. preferably.

The thumb and hand parts 28 and 30 may be formed of any durable polymeric material that is suitable for use with the dehydrating agent and with the leather emollients described below. One composition that is preferred for its chemical inertness, durability and manufacturing advantages is high density polyethylene. However, other common polymeric plastics are also considered suitable, such as polypropylene, rigid polyviny chloride (PVC), polycarbonate, nylon, and acrylonitrile butadiene styrene (ABS).

As already stated, the porous inner lining 14 of the case 10 is impregnated with a leather emollient which, by contact with the leather glove, is infused into the leather to maintain and restore its flexibility, suppleness and exterior finish. There are a number of leather emollient compositions which are suitable for this use. Most preferred are emollients consisting essentially of neatsfoot oil, lanolin and mixtures thereof. For example, one suitable emollient composition consists of a mixture of 60 percent by weight neatsfoot oil and 40 percent anyhdrous lanolin. Another suitable composition consists of equal parts neatsfoot oil and castor oil. Yet another suitable emollient composition consists of 50 percent by weight neatsfoot oil, 35 percent anyhydrous lanolin, 20 percent Japan wax, 8 percent soap, and sufficient water to give the composition a creamy texture suitable for application to and impregnation in the porous case lining. Other suitable emollient ingredients include menhaden oil, tallow, clove oil, and casein. To all of the above-described emollient compositions there may be added suitable scents and fragrances.

The porous inner lining 14 is preferably approximately one-eighth inch thick and formed of open cell or sintered polyvinyl chloride. Such a material is commercially available under the trademark Poron from Rogers Co. of Rogers, Conn. The pore size of such a foam lining is preferably 100 pores per linear inch, or less, in the case of open cell polyvinyl chloride, and 100 or more pores per linear inch in the case of sintered polyvinyl chloride.

Although the present invention is presented herein with reference to the above-described and illustrated preferred embodiment, it will be recognized that various substitutions, modifications an alterations may be made without departing from the spirit of the invention. Accordingly, the scope of the present invention is defined by the following claims.

What is claimed is:

1. An apparatus for preserving a leather glove, comprising a closable protective case having a porous inner lining suitable for impregnation with a leather emollient, and a hollow vapor-permeable hand-shaped form adapted to fit within a leather glove and contain a dehydrating agent, said hand-shaped form consisting of separable thumb and hand parts, each of said parts being hollow and permeable to water vapor, and wherein said case is sized to cooperably receive and enclose a glove containing said form, whereby during storage in said case moisture in a glove is extracted by action of said dehydrating agent in said hand-shaped form and said leather emollient is at the same time infused into said glove.

2. The apparatus defined in claim 1 wherein said hand part includes a convex exterior edge and said thumb part includes a cooperable concave exterior edge, whereby said thumb part may be rotated about said convex edge of said hand part, whereby the hand-shaped form may be fitted within either a left-handed or right-handed glove.

3. The apparatus defined in claim 1 further comprising a dehydrating agent consisting essentially of calcium sulfate.

4. The apparatus defined in claim 1 further comprising a dehydrating agent consisting essentially of silica gel.

5. The apparatus defined in claim 1 further comprising a leather emollient consisting essentially of neatsfoot oil, anydrous lanolin or mixtures thereof.

6. The apparatus defined in claim 1 wherein said hand-shaped form is formed of high density polyethylene.

7. The apparatus defined in claim 1 wherein said porous inner lining is formed of open cell polyvinyl chloride.

8. The apparatus defined in claim 7 wherein said inner lining has a pore size of 100 or fewer pores per linear inch.

* * * * *